US007274345B2

(12) United States Patent
Imamura et al.

(10) Patent No.: US 7,274,345 B2
(45) Date of Patent: Sep. 25, 2007

(54) ELECTRO-OPTICAL DEVICE AND DRIVING DEVICE THEREOF

(75) Inventors: Yoichi Imamura, Chino (JP); Toshiyuki Kasai, Okaya (JP); Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 673 days.

(21) Appl. No.: 10/844,485

(22) Filed: May 13, 2004

(65) Prior Publication Data

US 2004/0257353 A1 Dec. 23, 2004

(30) Foreign Application Priority Data

May 19, 2003 (JP) ..... 2003-140971
Mar. 23, 2004 (JP) ..... 2004-084650

(51) Int. Cl.
*G09G 3/30* (2006.01)

(52) U.S. Cl. ..... 345/76; 345/204

(58) Field of Classification Search ..... 345/36, 345/45, 48, 76, 84, 204
See application file for complete search history.

(56) References Cited

U.S. PATENT DOCUMENTS

| | | | | |
|---|---|---|---|---|
| 6,229,506 | B1 | 5/2001 | Dawson et al. | |
| 6,760,004 | B2 * | 7/2004 | Koyama | 345/98 |
| 6,859,193 | B1 * | 2/2005 | Yumoto | 345/82 |
| 6,917,350 | B2 * | 7/2005 | Pae et al. | 345/55 |
| 6,919,886 | B2 * | 7/2005 | Sato et al. | 345/205 |
| 6,947,019 | B2 * | 9/2005 | Sato et al. | 345/82 |
| 7,167,169 | B2 * | 1/2007 | Libsch et al. | 345/211 |
| 7,193,591 | B2 * | 3/2007 | Yumoto | 345/82 |
| 7,196,681 | B2 * | 3/2007 | Okuda | 345/76 |
| 2002/0030647 | A1 * | 3/2002 | Hack et al. | 345/82 |
| 2003/0090481 | A1 | 5/2003 | Kimura | |
| 2003/0112205 | A1 | 6/2003 | Yamada | |
| 2003/0156102 | A1 | 8/2003 | Kimura | |
| 2003/0174152 | A1 | 9/2003 | Noguchi | |

FOREIGN PATENT DOCUMENTS

| | | |
|---|---|---|
| JP | A 5-107561 | 4/1993 |
| JP | A 2001-147659 | 5/2001 |
| JP | A-2003-150106 | 5/2003 |
| JP | A-2003-186437 | 7/2003 |
| JP | A-2003-208127 | 7/2003 |
| JP | A-2003-216110 | 7/2003 |
| JP | A 2003-255856 | 9/2003 |
| JP | A-2003-271095 | 9/2003 |
| JP | A-2003-280582 | 10/2003 |
| JP | A-2003-295825 | 10/2003 |
| JP | A 2003-323152 | 11/2003 |
| WO | WO 01/06484 A1 | 1/2001 |
| WO | WO 03/038793 A1 | 5/2003 |

* cited by examiner

*Primary Examiner*—Richard Hjerpe
*Assistant Examiner*—Jean Lesperance
(74) *Attorney, Agent, or Firm*—Oliff & Berridge, PLC

(57) ABSTRACT

The invention provides an electro-optical device having circuits for driving electro-optical elements, such as organic EL elements, and a driving device, which can employ driving elements having low driving ability, such as α-TFTs. By providing a charge storage capacitor between the source electrode and the gate electrode of a driving transistor which is between power sources, the electro-optical device can allow the driving transistor to control a driving current, even when an electro-optical element is connected to the source side of the driving transistor. In addition, driving data can be stored in the charge storage capacitor by applying a predetermined voltage to the source electrode of the driving transistor.

24 Claims, 7 Drawing Sheets

ELECTRO-OPTICAL DEVICE AND DRIVING DEVICE THEREOF

BACKGROUND OF THE INVENTION

1. Field of Invention

The invention relates to an electro-optical device for performing display in information instruments such as televisions or computers. More specifically, the invention relates to a driving device for driving electro-optical elements such as organic electroluminescent elements.

2. Description of Related Art

In recent, since organic EL display devices have features as light weight, small thickness, high brightness, and wide viewing angle, the organic EL display devices had been paid attention to as monitor displays of portable information instruments, such as mobile phones. A typical active matrix organic EL display device has a construction that images are displayed through a plurality of display pixels arranged in a matrix. In the display pixels, a pixel circuit can be provided every pixel that is a minimum unit for display. The pixel circuits are circuits for controlling currents or voltages to be supplied to electro-optical elements.

In such an organic EL display device, a plurality of scanning lines are arranged along the rows of the display pixels, a plurality of data lines are arranged along the columns of the display pixels, and a plurality of pixel switches are arranged in the vicinity of intersections between the scanning lines and the data lines. Each display pixel comprises at least an organic EL element, a driving transistor connected in series to the organic EL element between a pair of power terminals, and a storage capacitor for holding a gate voltage of the driving transistor. The selecting switch of each pixel is electrically conducted in response to a scan signal supplied from the corresponding scanning line, and applies an image signal (voltage or current) supplied from the corresponding data line directly or a gray scale voltage as a result of correcting deviation in characteristics of the pixel circuit to the gate electrode of the driving transistor. The driving transistor supplies a driving current corresponding to the gray scale voltage to the organic EL element.

The organic EL element has a structure in which a light-emitting layer that is a thin film including a fluorescent organic compound of red, green or blue is inserted and held between a common electrode (cathode) and a pixel electrode (anode), generates exitons by injecting electrons and holes in the light-emitting layer and recombining them, and emits light by light emission occurring due to deactivation of the exitons. In a bottom emission type organic EL element, the electrode thereof is a transparent electrode made of ITO, etc., and the common electrode (cathode) is formed out of a reflecting electrode in which a resistance of an alkali metal is decreased using metal such as aluminum, etc. As a result, with an applied voltage of 10 V or less, a luminance of about 100 to 100,000 cd/m$^2$ can be obtained from the organic EL element itself.

Each pixel circuit of the aforementioned organic EL display device can include thin film transistors (TFTs) as active elements, as disclosed in Japanese Unexamined Patent Application Publication No. 5-107561. The thin film transistor is formed out of, for example, a low-temperature polysilicon TFT.

SUMMARY OF THE INVENTION

In the above-described kinds of display devices, in order to enhance display quality, it is preferable that an electrical characteristic of a pixel circuit be uniform in all pixels. However, in the low-temperature polysilicon TFT, deviation in characteristic during recrystallization thereof can be easily generated, and crystalline defects may be generated. For this reason, in a display device employing thin film transistors formed out of low-temperature polysilicon TFTs, it is extremely difficult to homogenize the electrical characteristics of the pixel circuits for all pixels. Specifically, since possibility that deviation in characteristics of the pixel circuits can be generated is further increased with increase in the number of pixels for increase in accuracy of display images or increase in screen size, a problem of decrease in display quality become more serious. Furthermore, because of restriction of a laser anneal apparatus for performing recrystallization, it is difficult to increase a substrate size and thus enhance productivity as in amorphous TFTs (α-TFTs).

On the other hand, the α-TFTs have relatively small deviation in characteristics of transistors and have actual achievement of mass production through increase of a substrate size in LCD performing an alternating current driving, but since a threshold voltage is shifted by normally and continuously applying the gate voltage in one way, current values are changed and the luminance is lowered, thereby having a bad influence on display quality. Furthermore, since the α-TFT has a small mobility, the current capable of performing the drive thereof with a fast response is restricted, and only the TFTs of n-channel are put to practical use.

Furthermore, due to restriction of the organic EL manufacturing technologies resulting from materials to be used, the conventional organic EL elements could not help having a structure that a TFT substrate side is used as a pixel electrode (anode) side and a surface side of the elements is used as a common electrode (cathode). Therefore, in a conventional pixel circuit shown in FIG. 9, relations among a common electrode power source 38, a pixel electrode (anode) of an organic EL element 16, and a p-channel driving TFT 61 are limited to a connection relation in which a driving transistor can operate in a saturation region, as shown in FIG. 9.

Furthermore, generally in a case where it is intended to keep the luminance of the organic EL element constant, the resistance of the organic EL element is increased as time passes, so that the organic EL element should be driven with a constant current. For this reason, the driving circuit can include three or more TFTs, and a p-channel TFT made of low-temperature polysilicon that can allow a constant current to flow regardless of change in load has been used as the driving TFT. In addition, in FIG. 9, when the driving transistor 61 is an n-channel TFT, the source electrode of the driving transistor 61 is connected to the organic EL element side (that is, form a source follower circuit), so that the current value is changed with change in load.

Furthermore, since the driving circuit requires a preliminary write signal for display data or a forced off signal to the pixels in addition to the power wiring lines or the scanning lines, it is difficult to supply the signals from an external driver IC due to restriction of a connection pitch of connection terminals. The number of connection terminals is limited to one or two every pixel.

For this reason, it has been considered that it is impossible to drive the organic EL elements by using the α-TFT.

An object of the invention to provide a driving circuit capable of employing driving elements having low driving ability such as α-TFTs in circuits for driving driven elements such as electro-optical elements, a driving method thereof, and an electro-optical device using the driving circuit.

According to a first aspect of the invention, there can be provided an electro-optical device including a plurality of scanning lines, a plurality of data lines, a plurality of pixels arranged correspondingly to intersections of the plurality of scanning lines and the plurality of data lines, and a plurality of first power wiring lines. Each of the plurality of pixels can include a first switching transistor the electrical conduction of which is controlled based on a scan signal supplied through the corresponding scanning line of the plurality of scanning lines, an electro-optical element having a pixel electrode, a common electrode, and an electro-optical material therebetween, a driving transistor connected to the electro-optical element, and a capacitor which has a first electrode and a second electrode forming a capacitance and which is connected to the gate of the driving transistor through the first electrode. The capacitor can hold, as electric charge, a data signal supplied through the first switching transistor and the corresponding data line of the plurality of data lines, an electrical conduction state of the driving transistor is set in accordance with the quantity of electric charge held in the capacitor, and the electro-optical element and the corresponding first power wiring line of the plurality of first power wiring lines are electrically connected to each other through the driving transistor in accordance with the electrical conduction state thereof. The second electrode can be connected between the driving transistor and the pixel electrode.

In this construction, since the capacitor for holding the electric charge is provided between the source electrode and the gate electrode of the driving transistor, even when the electro-optical element is connected in a source follower type to the driving transistor, a voltage $V_{GS}$ between the source and the gate of the driving transistor is kept constant in spite of change of the source voltage. As a result, the driving current corresponding to the data signal supplied through the data line is supplied to the electro-optical element, so that it is possible to allow the electro-optical element to operate with a predetermined characteristic.

The electro-optical element applied to the electro-optical device according to the invention converts electrical actions such as supply of current or application of voltage into optical actions such as change in luminance or light transmissivity, or converts the optical actions into the electrical actions. A typical example of such an electro-optical element includes an organic EL element that emits light with a luminance corresponding to the current supplied from the pixel circuit. However, the invention can be applied to devices employing electro-optical elements other than the organic EL elements.

In a preferred embodiment, a plurality of electro-optical elements can be arranged at different positions in a plane. For example, the plurality of electro-optical elements is arranged in a matrix along a row direction and a column direction.

In order to accomplish the above object, according to a second aspect of the present invention, there can be provided an electro-optical device comprising a plurality of scanning lines, a plurality of data lines, a plurality of pixels arranged correspondingly to intersections of the plurality of scanning lines and the plurality of data lines, and a plurality of first power wiring lines. Each of the plurality of pixels can include a first switching transistor the electrical conduction of which is controlled based on a scan signal supplied through the corresponding scanning line of the plurality of scanning lines, an electro-optical element having a pixel electrode, a common electrode, and an electro-optical material therebetween, a driving transistor connected to the electro-optical element, and a capacitor which has a first electrode and a second electrode forming a capacitance and which is connected to the gate of the driving transistor through the first electrode. The capacitor holds, as electric charge, a data signal supplied through the first switching transistor and the corresponding data line of the plurality of data lines, an electrical conduction state of the driving transistor is set in accordance with the quantity of electric charge held in the capacitor, and the electro-optical element and the corresponding first power wiring line of the plurality of first power wiring lines are electrically connected to each other through the driving transistor in accordance with the electrical conduction state thereof. The second electrode is connected between the driving transistor and the pixel electrode, and the second electrode is set to a first predetermined potential by electrically conducting switching device for controlling an electrical connection between the second electrode and the first predetermined potential.

According to this construction, when the data signal supplied through the data line is written to control the driving transistor, the source electrode of the driving transistor, to which the second electrode of the capacitor for holding the electric charge is connected, is set to a ground potential or a predetermined potential by means of the switching means. As a result, even when the electro-optical element is connected between the source electrode and the second power source, the data signal is written with a constant potential, so that the driving current of the driving transistor can be set to a value corresponding to the data signal in one to one. Therefore, it is possible to allow the electro-optical element to operate with a predetermined characteristic.

In a more specific embodiment of the electro-optical device according to the invention, the predetermined potential may be equal to a potential of the common electrode. According to this construction, the ground potential can be used without increasing the number of power sources of the electro-optical device, thereby causing reduction in power source cost.

In a further more specific embodiment of the electro-optical device according to the invention, the driving transistor may be an n-channel transistor or a p-channel transistor. According to this construction, without modifying the conventional method of manufacturing the organic EL elements, it is possible to accomplish enhancement in performance of the driving circuit by using the optimum transistor in consideration of abilities of the transistors constituting a TFT substrate or productivity of the TFT substrate.

In a more preferred embodiment, the driving transistor may be an amorphous thin film transistor (α-TFT). According to this construction, since the pixel portions occupying most area of the driving substrate can be formed out of the same kind of channel transistors, it is easy to manufacture the TFT substrate. A large-size electro-optical panel on which a plurality of electro-optical elements are arranged in a matrix can be early implemented by using an amorphous TFT technology established through a large size technology. Further, even in a case using polysilicon TFTs, it is preferable that the pixel portions be formed out of the same kind of channel transistors, because it is easy to optimize the conditions for manufacturing the TFTs.

In another embodiment, in each of the plurality of pixels, before the data signal can be supplied through the corresponding data line of the plurality of data lines, an electrode of the first switching transistor at a side holding the data signal may be set to a second predetermined potential other than the first predetermined potential. According to this construction, since the drive control device is initialized into a predetermined potential before the data signal is written, the gate voltage of the driving transistor can be converted into an AC voltage or compensation and detection of the threshold voltage of the driving transistor can be performed without influence of the data signal value, so that it is possible to suppress change in threshold voltage of the driving transistor.

In another embodiment, each of the plurality of pixels may further include a second switching transistor for controlling a connection between the electrode of the first switching transistor at the side holding the data signal and the second predetermined potential, and an electrical conduction state of the second switching transistor may be controlled by a periodic signal supplied before a scan signal for controlling an electrical conduction state of the first switching transistor is supplied. According to this construction, when the initialization is required before writing the data signal to the drive control device, it is possible to initialize the drive control means by using another period not affecting a timing of writing the data signal. Further, since the organic EL element does not emit light for the initialization period, the initialization period may be used as a lights-out period for a countermeasure against the moving picture faintness.

In another embodiment, the periodic signal for controlling the electrical conduction state of the second switching transistor may be supplied through one of the plurality of scanning lines before the scan signal for controlling the electrical conduction state of the first switching transistor is supplied. According to this construction, when the initialization is required before writing the data signal to the drive control means, the scan signal may be also used as the periodic preliminary write signal. As a result, it is possible to suppress increase in size of an internal circuit of the scanning line driver or increase in the number of connection terminals between the scanning line driver and the organic EL panel, and it is also possible to initialize the drive control means without affecting a sampling input time of the drive control means. This means that it is possible to easily realize the matrix driving circuit having a large size and more complex than the LCD by using transistors having low driving ability such as α-TFTs.

Furthermore, since the reset state is held until the next data signal is written to the pixels, this period can be used as a display-off state (drive-off state). A length of the display-off period can be determined depending upon which scan signal is used as the preliminary write signal. Therefore, in an active type display, a duty ratio of operation time of the electro-optical element can be properly changed in accordance with necessity of the countermeasure against the moving picture faintness. It is preferable that the duty ratio of operation time be 60 to 10%.

In a preferred embodiment of the invention, in each of the plurality of pixels, the second electrode may be set to the first predetermined potential no later than when the data signal supplied through the corresponding data line of the plurality of data lines is intercepted by the first switching transistor. According to this construction, even when the source of the driving transistor is connected to the organic EL element, since the source voltage which is a reference of the gate voltage for controlling the driving current of the driving transistor is set to a predetermined potential until the timing when the writing of the data signal is completed, it is possible to accumulate the electric charge corresponding to the data signal by using the predetermined potential as a reference. As a result, the driving current of the driving transistor can be set to a value corresponding to the data signal in one to one. Therefore, it is possible to allow the organic EL element to emit light with a predetermined luminance.

In a more preferred embodiment, each of the plurality of pixels may further include a plurality of second power wiring lines for supplying the first predetermined potential to the second electrode included in each of the plurality of pixels. According to this construction, it is possible to independently supply the first predetermined potential to the respective pixels.

In another embodiment, the plurality of first power wiring lines and the plurality of second power wiring lines may share a metal wiring layer portion, and may be arranged to intersect each other. According to this construction, since the first power wiring lines can be arranged prior to the other signal lines or power wiring lines, it is possible to supply power to the first power wiring lines in low impedance and low cross-talk. Furthermore, it is possible to efficiently form a light-shielding layer of the TFT by using a metal wiring line.

In order to accomplish the above object, according to a third aspect of the invention, there can be provided an electro-optical device having a plurality of scanning lines, a plurality of data lines, a plurality of pixels arranged correspondingly to intersections of the plurality of scanning lines and the plurality of data lines, and a plurality of first power wiring lines. Each of the plurality of pixels can include a first switching transistor the electrical conduction of which is controlled based on a scan signal supplied through the corresponding scanning line of the plurality of scanning lines, an electro-optical element having a pixel electrode, a common electrode, and an electro-optical material therebetween, a driving transistor connected to the electro-optical element, and a capacitor which has a first electrode and a second electrode forming a capacitance and which is connected to the gate of the driving transistor through the first electrode. The capacitor can hold, as electric charge, a data signal supplied through the first switching transistor and the corresponding data line of the plurality of data lines, an electrical conduction state of the driving transistor is set in accordance with the quantity of electric charge held in the capacitor, and the electro-optical element and the corresponding first power wiring line of the plurality of first power wiring lines are electrically connected to each other through the driving transistor in accordance with the electrical conduction state thereof. The electro-optical element can be set to a non-activated state based on a scan signal supplied through one of the plurality of scanning lines, before the scan signal for controlling an electrical conduction state of the first switching transistor is supplied.

According to this construction, in order to realize secondary adjustment functions in a case where a display blank period is prepared every frame for the countermeasure against the moving picture faintness or in a case of a duty driving for adjusting the display brightness in a wide range, a periodic control line having a timing different from the scan signal is required in the scanning line direction every pixel driving circuit, but since the pixel driving circuits can be controlled through combination of the scanning lines without increasing the number of connection terminals according to this embodiment, it is possible to more accurately realize a display having excellent display quality.

Furthermore, in another embodiment, the electro-optical element may be an organic EL element. According to this construction, since the organic EL element has a low driving voltage and smaller driving current can allow the light emitting with a high luminance with advancement of light-emitting materials, etc., it is possible to implement a large-size display with relatively low power consumption.

According to an aspect of the invention, there can be provided a driving device for driving a plurality of electro-optical elements arranged in a matrix, the driving device comprising a plurality of scanning lines, a plurality of data lines, a plurality of first power wiring lines, and a plurality of pixel circuits arranged correspondingly to intersections of the plurality of scanning lines and the plurality of data lines. Each of the plurality of pixel circuits can include a first switching transistor the electrical conduction of which is controlled based on a scan signal supplied through the corresponding scanning line of the plurality of scanning lines, a driving transistor for controlling current to be supplied to the electro-optical element in accordance with an electrical conduction state thereof, and a capacitor which has a first electrode and a second electrode forming a capacitance and which is connected to the gate of the driving transistor through the first electrode. The capacitor can hold, as electric charge, a data signal supplied through the first switching transistor and the corresponding data line of the plurality of data lines, the electrical conduction state of the driving transistor is set in accordance with the quantity of electric charge held in the capacitor, and current having a current level corresponding to the electrical conduction state is supplied to the corresponding electro-optical element of the plurality of electro-optical elements through the driving transistor from the corresponding first power wiring line of the plurality of first power wiring lines. The second electrode can be connected to the source of the driving transistor, and for at least a period before the data signal is supplied to the capacitor, the source of the driving transistor is electrically connected to a first predetermined potential through a switching device.

According to this construction, when the data signal supplied through the data line is written to control the driving transistor, the source electrode of the driving transistor to which the second electrode of the capacitor for holding the electric charge in the driving device is connected is set to a ground potential or a predetermined potential by the switching device. As a result, even when the electro-optical element can be connected between the source electrode and the second power source, the data signal is written with a constant potential, so that the driving current of the driving transistor can be supplied with a value corresponding to the data signal in one to one. Therefore, if the electro-optical element is connected to the driving device, it is possible to allow the electro-optical element to operate with a predetermined characteristic.

In another preferred embodiment, the driving transistor may be an n-channel transistor or a p-channel transistor. According to this construction, without modifying the conventional method of manufacturing the organic EL elements, it is possible to accomplish enhancement in performance of the driving circuit by using the optimum transistor in consideration of abilities of the transistors constituting a TFT substrate or productivity of the TFT substrate.

In another preferred embodiment, the driving transistor and the first switching transistor may be an amorphous thin film transistor. According to this construction, since the pixel portions occupying most area of the driving substrate can be formed out of the same kind of channel transistors, it is easy to manufacture the TFT substrate, and a large-size electro-optical panel on which a plurality of electro-optical elements are arranged in a matrix can be early implemented by using an amorphous TFT technology established through a large size technology.

In another preferred embodiment, for at least a period before the data signal is supplied to the capacitor, an electrode of the first switching transistor at a side holding the data signal may be set to a second predetermined potential other than the first predetermined potential.

According to this construction, since the drive control device is initialized into a predetermined potential before the data signal is written, the gate voltage of the driving transistor can be converted into an AC voltage or compensation and detection of the threshold voltage of the driving transistor can be performed without influence of the data signal value, so that it is possible to suppress change in threshold voltage of the driving transistor.

In another preferred embodiment, each of the plurality of pixel circuits may further include a second switching transistor for controlling a connection between the electrode of the first switching transistor at the side holding the data signal and the second predetermined potential, and an electrical conduction state of the second switching transistor may be controlled by means of a periodic signal supplied before a scan signal for controlling an electrical conduction state of the first switching transistor is supplied. According to this construction, when the initialization is required before writing the data signal to the drive control means, it is possible to initialize the drive control means by using a different period not affecting a timing of writing the data signal.

The periodic signal for controlling the electrical conduction state of the second switching transistor may be supplied through one of the plurality of scanning lines before the scan signal for controlling the electrical conduction state of the first switching transistor is supplied. According to this construction, when the preliminary write is required before writing the data signal to the drive control means, the previous scan signal may be also used as the preliminary write signal. As a result, it is possible to suppress increase in size of an internal circuit of the scanning line driver or increase in the number of connection terminals between the scanning line driver and the organic EL panel, and it is also possible to initialize the drive control device without affecting a sampling input time of the data signal to the drive control device. This means that it is possible to easily realize the large-size matrix driving circuit by using transistors having low driving ability such as α-TFTs.

In a more specific embodiment, the second switching transistor and the switching means may be all controlled by a common signal. According to this construction, the number of signal lines for controlling the second switching transistor and the switching device can be minimized, and it is also possible to accurately accumulate the data signal in the capacitor connected to the gate of the driving transistor.

In another preferred embodiment, each of the plurality of pixel circuits may further include a plurality of second power wiring lines for setting a potential of the source of the driving transistor to the first predetermined potential through the switching device. According to this construction, it is possible to independently supply the first predetermined potential to the respective pixels.

In another preferred embodiment, the plurality of first power wiring lines and the plurality of second power wiring lines may share a metal wiring layer portion, and may be arranged to intersect each other. According to this construction, since the first power wiring lines can be arranged prior to the other signal lines or power wiring lines, it is possible to supply power to the first power wiring lines in low impedance and low cross-talk. Furthermore, it is possible to efficiently form a light-shielding layer of the TFT by using a power source metal wiring line.

In another specific embodiment, the first predetermined potential may be equal or substantially equal to that of a potential of the plurality of first power wiring lines or a potential of the plurality of second power wiring lines whichever is lower. According to this construction, since the first predetermined potential can be supplied from the second power wiring lines, it is possible to simplify a construction of the power source.

According to another aspect of the invention, there can be provided a driving device for driving a plurality of electro-optical elements arranged in a matrix, the driving device comprising a plurality of scanning lines, a plurality of data lines, a plurality of first power wiring lines, and a plurality of pixel circuits arranged correspondingly to intersections of the plurality of scanning lines and the plurality of data lines. Each of the plurality of pixel circuits comprises a first transistor of which the electrical conduction is controlled based on a scan signal supplied through the corresponding scanning line of the plurality of scanning lines, a driving transistor for controlling current to be supplied to the electro-optical element in accordance with an electrical conduction state thereof, and a capacitor which has a first electrode and a second electrode forming a capacitance and which is connected to the gate of the driving transistor through the first electrode. The capacitor can hold, as electric charge, a data signal supplied through the first switching transistor and the corresponding data line of the plurality of data lines, the electrical conduction state of the driving transistor is set in accordance with the quantity of electric charge held in the capacitor, and current having a current level corresponding to the electrical conduction state is supplied to the corresponding electro-optical element of the plurality of electro-optical elements through the driving transistor from the corresponding first power wiring line of the plurality of first power wiring lines. The second electrode can be connected to the source of the driving transistor, and wherein for at least a period when the capacitor holds the quantity of electric charge corresponding to the data signal, a device for keeping constant a potential difference between the source and the gate of the driving transistor is further provided. According to this construction, since the quantity of electric charge stored in the capacitor is held, the potential difference between the source and the gate of the driving transistor is not changed. For this reason, even when the driving transistor is connected in a source follower type to the electro-optical elements, it is possible to allow the driving current corresponding to the data signal to flow.

According to the invention, since the electro-optical elements manufactured through a conventional manufacturing method can be driven by means of a driving circuit comprising mono-channel TFTs such as α-TFTs, it is possible to realize a large-size electro-optical device, which was not possible conventionally. Specifically, when the invention can be applied to an organic EL display device, it is possible to obtain an active substrate capable of realizing a large-screen display, which is very thin and has excellent display quality. When different kinds of periodic control lines are required in the scanning line direction every pixel driving circuit in order to adjust a moving picture having a sharp profile or a display brightness with a wide range, the pixel driving circuits can be controlled by combination of the scanning lines without increase in the number of connection terminals, so that it is possible to realize a display having excellent display quality with more accuracy.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

Figure 1:
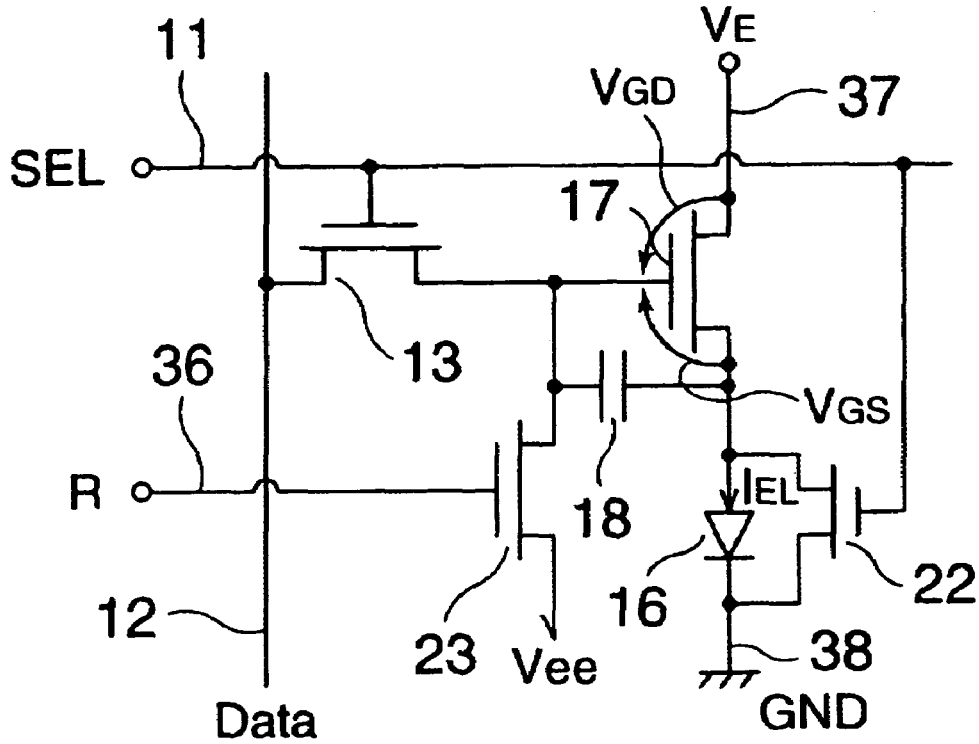
FIG. 1 is a diagram illustrating a construction of a pixel circuit according to a first embodiment of the invention.

Now, embodiments of the invention will be described with reference to the accompanying drawings. The embodiment to be hereinafter described expresses an aspect of the invention, however, it should be understood that they not limit the invention, and may be arbitrarily modified within a scope of the invention. In the drawings referred to hereinafter, in order to recognize respective constituent elements, sizes and ratios of the respective constituent elements are properly shown to be different from the actual ones.

Figure 6:
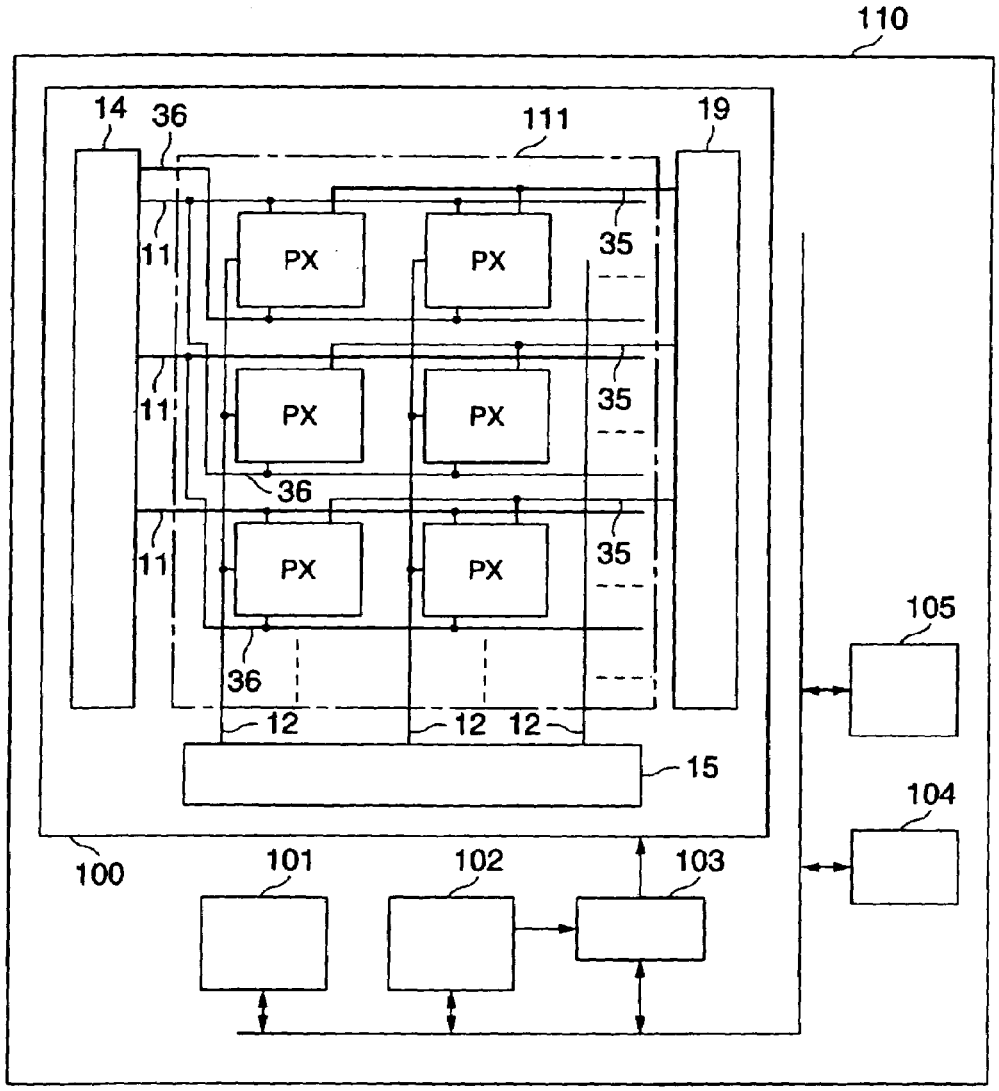
FIG. 6 is a block diagram illustrating a construction of an electro-optical device according to an embodiment of the invention.

First, an embodiment in which an electro-optical device according to the invention as a device for displaying images is applied to an organic EL display device will be described. FIG. 6 shows a construction of the organic EL display device 110. The organic EL display device 110 can include a display module 100 including an organic EL panel 111 and an external driving circuit for driving the organic EL panel 111, and a peripheral control unit.

The display module 100 can include the organic EL panel 111 and the external driving circuit. The organic EL panel 111 can have a plurality of display pixels PX arranged in a matrix on a glass substrate to display images, a plurality of scanning lines 11 arranged along rows of the display pixels PX, a plurality of data lines 12 arranged along columns of the display pixels PX, and a plurality of pixel power wiring lines 35. The external driving circuit includes a scanning line driver 14 for driving the plurality of scanning lines, a pixel power supply circuit 19 for supplying driving current to organic EL elements in the display pixels PX, and a data line driver 15 for outputting pixel driving signals to the data lines. The pixel power supply circuit 19 may be omitted depending upon difference in construction of the display pixels PX.

In the display pixel circuit shown in FIG. 1 which is the first embodiment, each display pixel PX can include an organic EL element 16, a driving transistor 17 which is an n-channel thin film transistor (TFT) connected in series to the organic EL element 16 between a pair of first and second power terminals $V_E$ and a ground power terminal GND, a storage capacitor 18 for holding the gate voltage of the driving transistor 17, an n-channel electrical conduction transistor 22 for allowing terminals of the organic EL element 16 to have substantially the same potential, a pixel selecting switch 13 for selectively applying an image signal from the corresponding data line 12 to the gate of the driving transistor 17, and a reset transistor 23 for initializing the gate potential of the driving transistor 17 into a predetermined potential Vee.

The power terminal $V_E$ is set to, for example, a predetermined potential of +28 V, and the ground power terminal GND is set to a potential of, for example, 0 V which is lower than the predetermined potential. All the transistors constituting each pixel circuit are formed of an n-channel TFT. The pixel selecting switch 13 applies a gray scale voltage Vsig of the image signals supplied from the corresponding data line 12 to the gate of the driving transistor 17, when it is electrically driven by the scan signal supplied from the corresponding scanning line 11. The driving transistor 17 supplies driving current Id corresponding to the gray scale voltage Vsig to the organic EL element 16. The organic EL element 16 emits light with a luminance corresponding to the driving current Id.

The data line driver 15 converts the image signals which is output from a display controller 103 and which is the digital format into the analog format and supplies voltages of the image signals in parallel to the plurality of data lines 12 during each horizontal scanning period. The scanning line driver 14 sequentially supplies the scanning signals to the plurality of scanning lines 11 during each vertical scanning period. The pixel selecting switches 13 in each row are electrically conducted only during one vertical scanning period by the scanning signal supplied in common from the corresponding scanning line of the plurality of scanning lines 11, and are not electrically conducted during a time period (one frame) until the scanning signal is supplied again after the one vertical scanning period. The electrical conduction of the pixel selecting switch 13, the driving transistors 17 in one row supply the driving currents corresponding to the voltages of the image signals supplied from the corresponding data lines 12 to the corresponding organic EL elements 16.

In addition, the scanning line driver 14 electrically conducts the reset transistor 23 connected between the gate of the driving transistor 17 and the power source Vee before outputting the scanning signals, and outputs a periodic preliminary write signal R, so that the gate potential of the driving transistor is allowed to temporarily become the predetermined voltage Vee and thus the driving current is allowed not to flow in the corresponding organic EL element. As the preliminary write signal R, the scan signal output to the pixel circuits at a front stage by one row or specific rows prior to the scanning line may be used as shown in FIG. 6. This construction can be implemented by additionally providing the scanning lines, and does not increase the number of connection terminals between the organic EL panel 111 and the scanning line driver. In addition, as a preliminary write signal line 36 connected to the pixel circuits of a first stage, the scanning line drawn out from a rear end of the scanning line driver 14 may be used. Since this reset state is held until next data signals are written to the pixels, this period can be used as a compulsory display-off period (drive-off period). A length of the display-off period can be determined depending upon which scan signal is used as the preliminary write signal. Therefore, in an active type display, a duty ratio of a light emitting time of the organic EL element 16 can be properly changed depending upon necessity for a countermeasure against moving picture faintness. The duty ratio of the light emitting time is preferably 60 to 10%.

The display pixel PX can include the storage capacitor 18 connected between the gate electrode and the source electrode of the driving transistor 17, and the electrical conduction transistor 22 connected between the source electrode of the driving transistor 17 and the GND electrode. The scanning line 11 is connected to the gate electrode of the electrical conduction transistor 22, and the electrical conduction transistor is electrically conducted at the same time as the electrical conduction of the pixel selecting switch 13. As a result, without influence of the inter-terminal voltage of the organic EL element 16, the gray scale voltage Vsig of the image signal supplied from the corresponding data line 12 is stored in the storage capacitor 18. During the electrical conduction of the electrical conduction transistor 22, since current does not flow in the organic EL element 16, the organic EL element 16 does not emit light. Further, a switch for electrically disconnecting the power source $V_E$ and the driving transistor 17 in synchronism with the electrical conduction of the electrical conduction transistor 22 may be provided therebetween.

Next, when the scanning line enters a non-selected state, and thus the pixel selecting switch 13 and the electrical conduction transistor 22 become electrically non-conducted, constant current corresponding to the voltage stored in the storage capacitor 18 is supplied to the organic EL element 16 from the driving transistor 17, so that the organic EL element emits light. In this case, the source potential of the driving transistor 17 is increased with increase in potential of the organic EL element 16 to form a source follower circuit type, but the potential between the source electrode and the gate electrode of the driving transistor is held by means of the storage capacitor 18. In addition, a voltage required for allowing the driving transistor 17 to operate in a saturation region is supplied to the power terminal $V_E$. As a result, the driving transistor 17 supplies the constant current corresponding to the gate potential thereof to the organic EL element 16, and thus the organic EL element 16 emits light with a constant luminance during one frame period until a next preliminary write signal R is input.

Figure 2:
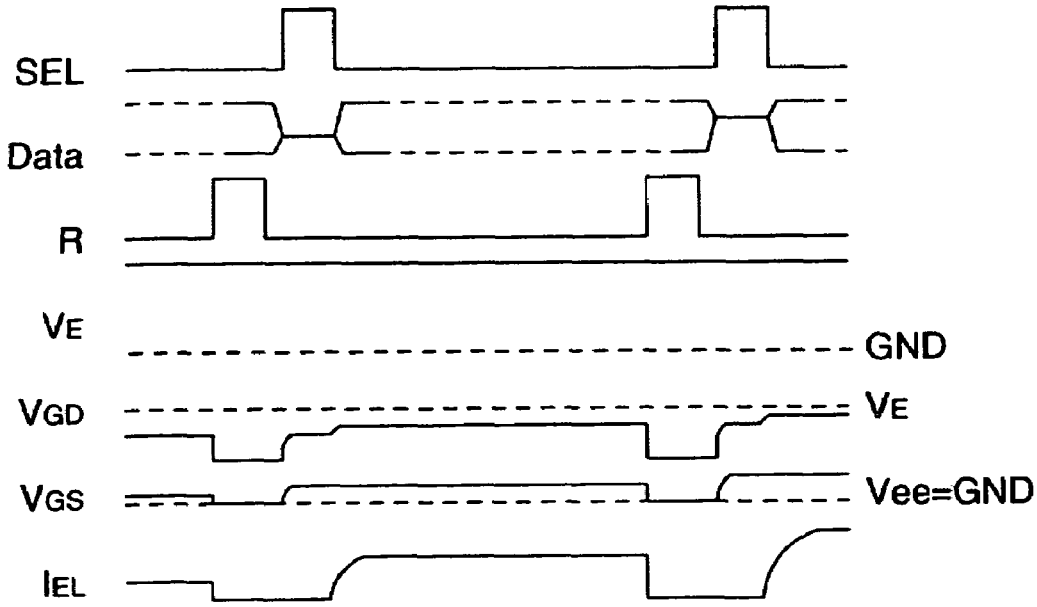
FIG. 2 is a timing chart illustrating operation of the pixel circuit shown in FIG. 1.

This series of timing chart is shown in FIG. 2. In the drawing, the gate voltage $V_{GD}$ as seen from the drain of the driving transistor 17 is changed in an alternating current manner. As a result, change in threshold voltage of the driving transistor 17 requiring stability in characteristics to maintain display quality is suppressed. As for a low driving ability of α-TFT, the same driving ability as a low-temperature polysilicon TFT can be obtained by increasing the voltage higher than the low-temperature polysilicon TFT by ten to twenty V.

In the above description, the source electrode of the electrical conduction transistor 22 is connected to the common electrode (cathode) of the organic EL element 16, but a voltage supply line having a specific voltage range in which the organic EL element 16 does not emit light may be further provided and connected to the source electrode of the electrical conduction transistor. If this specific voltage value is set to a voltage close to the threshold voltage of the organic EL element 16, it is also possible to suppress delay in emitting light due to a capacitor parasitic on the organic EL element. In order to suppress deviation in characteristics of the driving transistor 17, the driving transistor 17 may have a construction that a plurality of transistors is connected in parallel.

Figure 3:
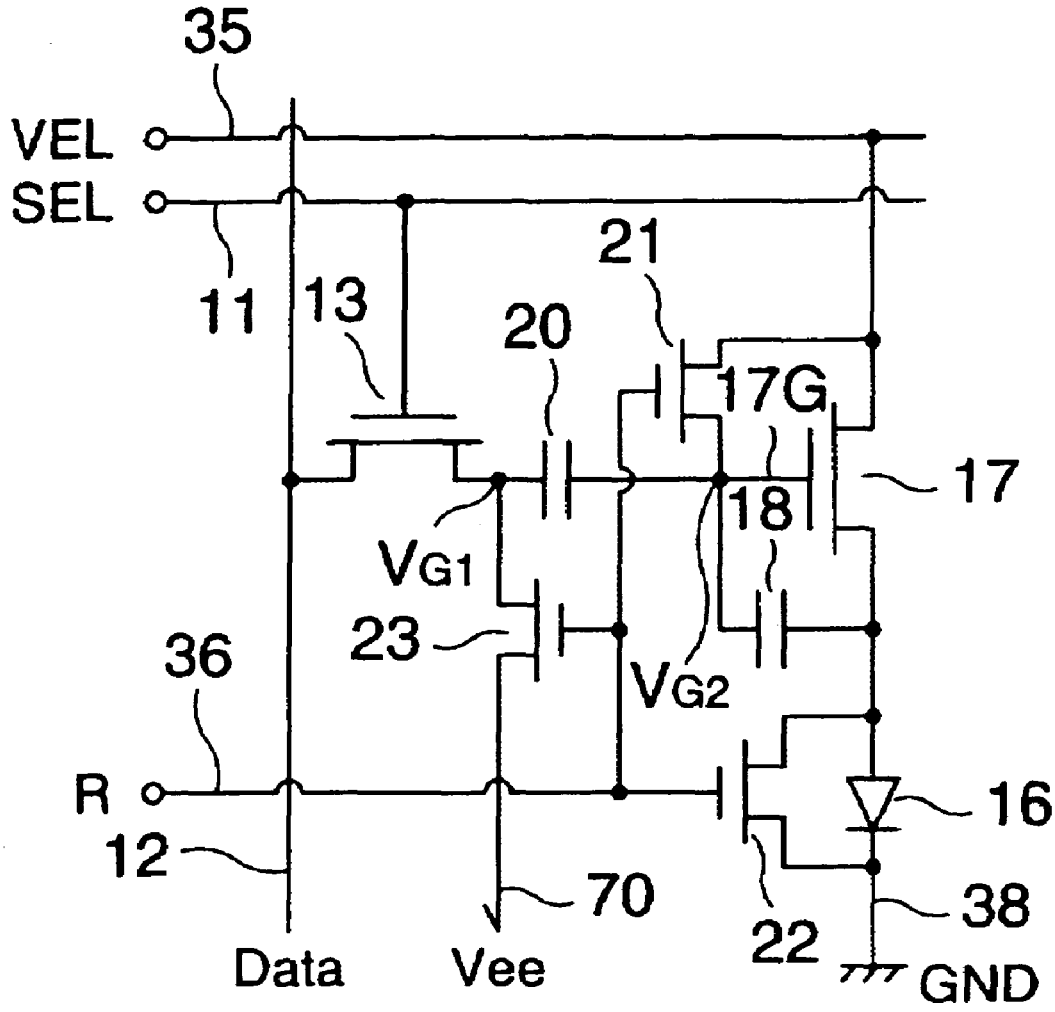
FIG. 3 is a diagram illustrating a construction of a pixel circuit according to a second embodiment of the invention.

FIG. 3 shows a display pixel circuit according to a second embodiment of the invention. A display pixel PX in the drawing can include a threshold voltage compensating circuit for the driving transistor 17, the threshold voltage compensating circuit including a kick capacitor 20 connected in series between the pixel selecting switch 13 and the gate electrode of the driving transistor 17, a bias transistor 21 connected between the gate electrode and the drain electrode of the driving transistor 17, the storage capacitor 18 connected between the gate electrode and the source electrode of the driving transistor 17, the electrical conduction transistor 22 for electrically connecting the pixel electrode and the common electrode (cathode) of an organic EL element, and the reset transistor 23 connected between a connection point of the pixel selecting switch 13 and the kick capacitor 20 and a power source Vee.

The respective transistors in the display pixel circuit are formed as an n-channel TFT, the pixel selecting switching 13 is controlled by the scan signal SEL from an outside, and the bias transistor 21, the electrical conduction transistor 22 and the reset transistor 23 are controlled by a preliminary write signal R from an outside.

By means of these controls, the bias transistor 21 is electrically conducted only when a predetermined voltage Vee is being supplied thereto through the reset transistor 23, and the electrical conduction transistor 22 is electrically conducted at the same time, so that the ground potential GND is supplied to the source electrode of the driving transistor 17. At that time, the organic EL element 16 does not emit light.

In this threshold voltage compensating circuit, prior to the scan signal SEL periodically input, the preliminary write signal R is applied to the gate electrode of the reset transistor 23, and the predetermined voltage Vee is supplied through the reset transistor 23, so that the bias transistor 21 and the electrical conduction transistor 22 are electrically conducted. At that time, although the power source VEL is in a high impedance state, the node potential between the gate electrode of the driving transistor 17 and the kick capacitor 20 is increased until the gate voltage becomes equal to the threshold voltage Vth of the driving transistor 17, by means of the current flowing through the bias transistor 21 from the residual electric charge on the power wiring line 35.

After the node potential is stabilized, the preliminary write signal R becomes a non-activated state ("L" level), so that the reset transistor 23, the electrical conduction transistor 22 and the bias transistor 21 are electrically non-conducted. As a result, the second electrode of the storage capacitor 18 is set to the GND potential, and the organic EL element 16 becomes a light non-emitting state. This state is held while the power source VEL is in a high impedance state. In other words, even when a time difference exists between the input timings of the preliminary write signal R and the scan signal SEL, the above state is held, and thus the organic EL element 16 does not emitting light. Next, when the scan signal is applied to the gate electrode of the pixel selecting switch 13 and the voltage of the image signal is supplied, the node potential $V_{G2}$ between the gate electrode of the driving transistor 17 and the kick capacitor 20 becomes a level obtained by adding the threshold voltage Vth to the voltage of the image signal.

Next, the power source VEL is supplied after the scan signal SEL becomes a non-selected state and the pixel selecting switch 13 is electrically non-conducted, and then the predetermined driving current in which Vth is compensated for flows to the organic EL element 16 through the driving transistor 17 from the power source VEL. Here, as described in the first embodiment, the source potential of the driving transistor 17 is increased with increase in potential between the electrodes of the organic EL element to form a source follower circuit type, but the potential between the source electrode and the gate electrode of the driving transistor is held by means of the storage capacitor 18. As a result, the driving current is determined in accordance with the potential difference between the predetermined voltage Vee and the voltage of the image signal, and thus even when deviation in threshold voltage Vth of the driving transistor 17 exists, the driving current is not affected.

Figure 4:
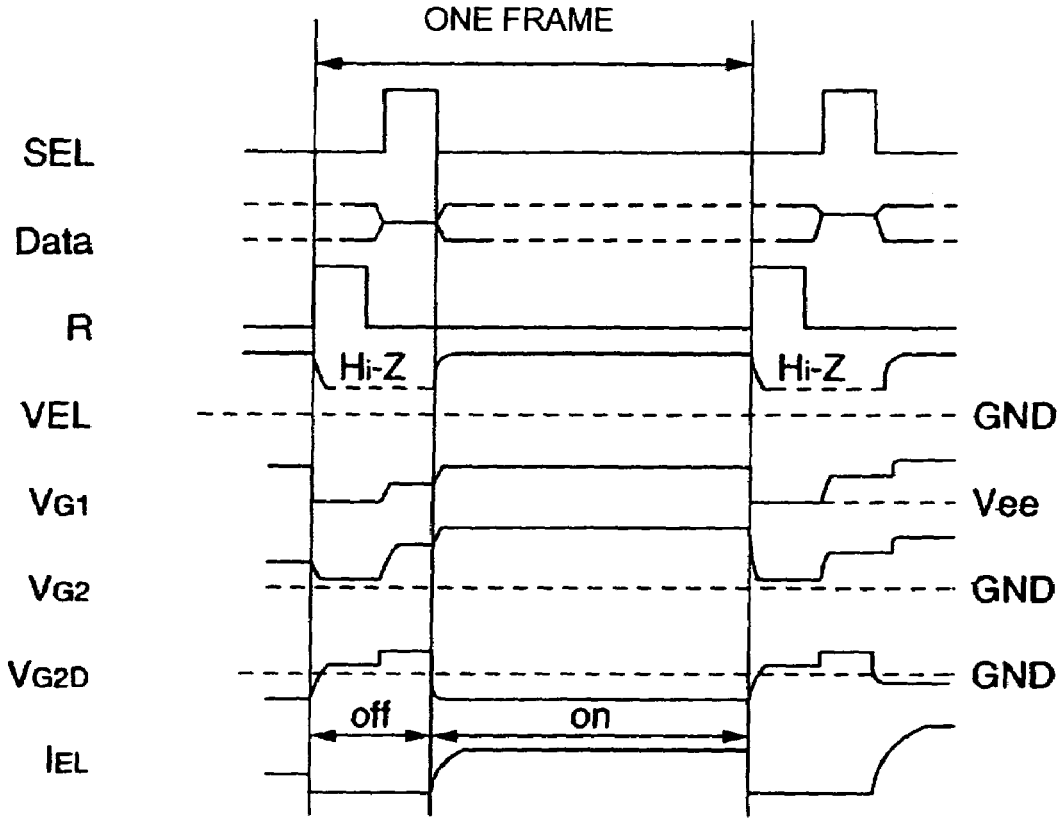
FIG. 4 is a timing chart illustrating operation of the pixel circuit shown in FIG. 3.

This series of timing operations are shown in FIG. 4. During performing a display function, this series of actions are periodically repeated. In the drawing, the gate voltage $V_{G2D}$ as seen from the drain electrode of the driving transistor 17 is changed in the alternating current manner about the GND potential. As a result, change in threshold voltage of the driving transistor 17 requiring stability in characteristics to maintain display quality is suppressed.

Figure 7:
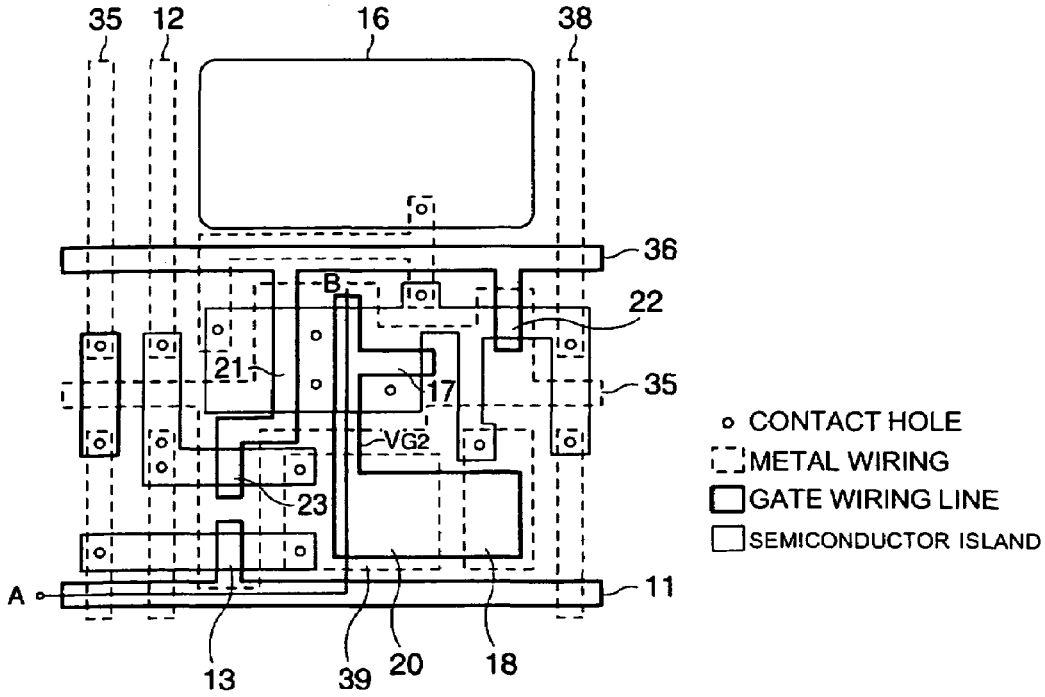
FIG. 7 is a diagram illustrating an example of a plan layout of the pixel circuit according to the second embodiment of the invention.

Furthermore, as shown in FIG. 7, the driving transistor 17 may have a construction that the driving transistor is divided in two directions of a left-right direction and an up-down direction, or into a plurality of transistors and they are connected in parallel, in order to suppress deviation in characteristics. Alternatively, the driving transistor may have a ring gate structure that an electric field is easily homogenized.

Figure 5:
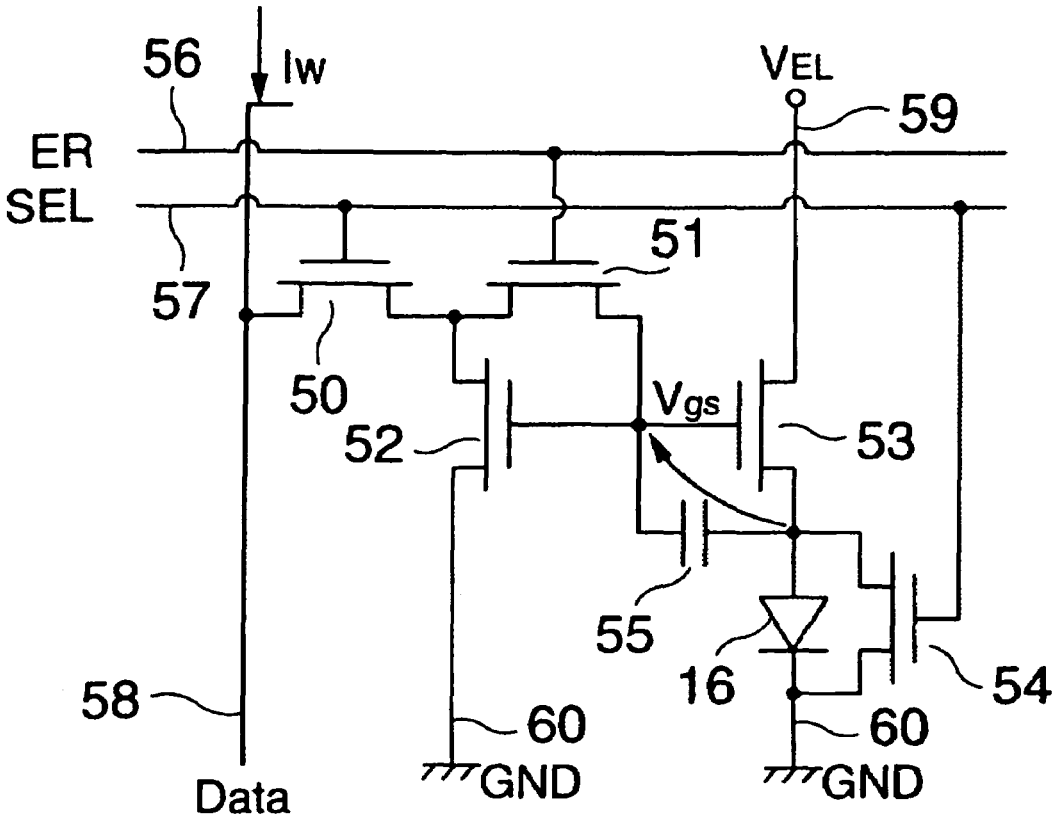
FIG. 5 is a diagram illustrating a construction of a pixel circuit according to a third embodiment of the invention.
Figure 10:
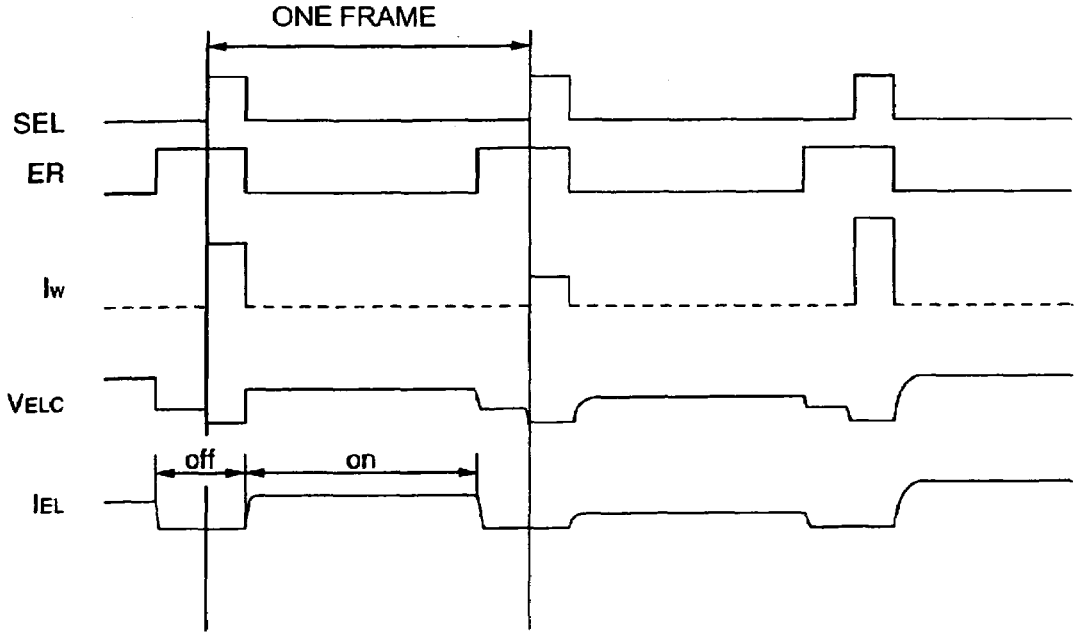
FIG. 10 is a timing chart illustrating operation of the pixel circuit shown in FIG. 5.

A third embodiment of the invention will be described with reference to a display pixel circuit shown in FIG. 5 and a timing chart shown in FIG. 10. The display pixel PX shown in FIG. 5 is a current-programming pixel circuit unlike the first and second embodiments. The display pixel PX shown in FIG. 5 can include a pixel selecting switch 50 connected to a data line 58, a conversion transistor 52 connected to the pixel selecting switch 50 and a ground power wiring line 60 (GND), a bias transistor 51 for connecting the gate electrode and the drain electrode of the conversion transistor 52, a driving transistor 53 the gate electrode of which is connected to the gate electrode of the conversion transistor 52 and which constitutes a current mirror circuit together with the conversion transistor 52, a capacitor 55 connected between the gate electrode of the driving transistor 53 and the organic EL element 16, an electrical conduction transistor 54 connected between a pixel electrode (anode) of the organic EL element 16 and a common electrode (cathode), and a power source VEL connected to the drain electrode of the driving transistor 53.

The respective transistors in the display pixel circuit are formed out of an n-channel TFT, the pixel selecting switch 50 and the electrical conduction transistor 54 are controlled by a scan signal SEL from an outside, and the bias transistor 51 is controlled by a periodic erase signal ER from an outside.

First, the scan signal SEL and the erase signal ER are allowed to become a selected state during the current programming. However, as shown in FIG. 10, the erase signal ER may be allowed to become the selected state prior to the scan signal SEL, so that the bias transistor 51 is electrically conducted and the gate electrode of the driving transistor 53 is set substantially to an off potential. In this case, as the erase signal ER, a logical sum (OR) of the scan signal SEL and one of a plurality of scanning line outputs supplied prior to the scan signal SEL may be used. As a result, the display-off period for the countermeasure against the moving picture faintness described in the first and second embodiments can be set. Accordingly, a light non-emitting period is periodically and necessarily inserted into one frame period of the respective pixel, and thus it is possible to prevent a phenomenon that profiles of the moving picture are faint. A ratio of the light emitting period for the countermeasure against the moving picture faintness is preferably 60 to 10% of the total period.

Next, when the scan signal SEL enters the selected state, the electrical conduction transistor 54 is electrically conducted, and the potential $V_{ELC}$ of the source electrode of the driving transistor 53 becomes substantially equal to the ground power source GND. At that time, since the pixel selecting switch 50 and the bias transistor 51 are electrically conducted, a signal current Iw corresponding to brightness data of the image signals flows in the conversion transistor 52, by connecting a current source CS corresponding to the image signals to the data line 58. The current source CS is provided in the data line driver 15 shown in FIG. 6, and is a variable current source to be controlled in accordance with the brightness data. At that time, since the gate electrode and the drain electrode of the conversion transistor 52 are electrically connected through the bias transistor 51, the conversion transistor 52 operates in a saturation region. The voltage Vgs between the gate electrode and the source electrode of the conversion transistor 52 at that time is accumulated in the storage capacitor 55. Since the electrical conduction transistor 54 is electrically conducted while the scan signal SEL is in the selected state, the current $I_{EL}$ does not flow in the organic EL element 16, even when the bias voltage Vgs is applied to the gate electrode of the driving transistor 53.

Next, the scan signal SEL and the erase signal ER enter the non-selected state. As a result, the pixel selecting switch (transistor) 50, the bias transistor 51, and the electrical conduction transistor 54 become electrically non-conducted, and the voltage Vgs between the gate electrode and the source electrode accumulated in the capacitor 55 is held. Therefore, the driving transistor 53 forming a current mirror circuit together with the conversion transistor 52 allows the driving current decreased at a size ratio between the conversion transistor 52 and the driving transistor 53 to flow in the organic EL element 16 from the power source VEL. The above operations are periodically repeated every frame, thereby performing a display.

Here, as described in the first embodiment, the source potential $V_{ELC}$ of the driving transistor 53 is increased with increase in potential of the organic EL element 16 to form a source follower circuit type, but the potential between the source electrode and the gate electrode of the driving transistor 53 is held as a value during performing the current programming by means of the storage capacitor 55. As a result, a constant current corresponding to the brightness data of the image signals flows in the organic EL element 16, and the organic EL element is driven to hold the luminous brightness during a period (one frame) until a next current programming is performed. Change in threshold voltage due to application of one-way bias can be easily caused in the gate potential of the conversion transistor 52 and the driving transistor 53, but the change in threshold voltage is absorbed and compensated for during performing the current programming.

In order to enhance accuracy of the held voltage Vgs during performing the current programming, a switching transistor may be provided between the driving transistor 53 and the power source VEL, or as described in the second embodiment, the power source VEL may be set to a high impedance so that current is not allowed to flow in the organic EL element 16. On the other hand, if a method of manufacturing an organic EL element would be advanced so that an anode common type organic EL element can be easily manufactured and thus the organic EL element 16 can be connected to the drain side of the driving transistor 53, the electrical conduction transistor 54 connected in parallel to the organic EL element 16 may be omitted.

However, the electrical conduction transistor is necessary for a case where the organic EL element 16 is allowed not to emit light during performing the current programming to the pixel circuit. During performing the current programming, a reverse bias may be applied to the organic EL element 16 or the driving transistor 53, by connecting the source electrode of the electrical conduction transistor 54 to another power source other than the ground power source GND and connecting the drain electrode thereof to a connection point between the organic El element 16 and the driving transistor 53.

Figure 8:
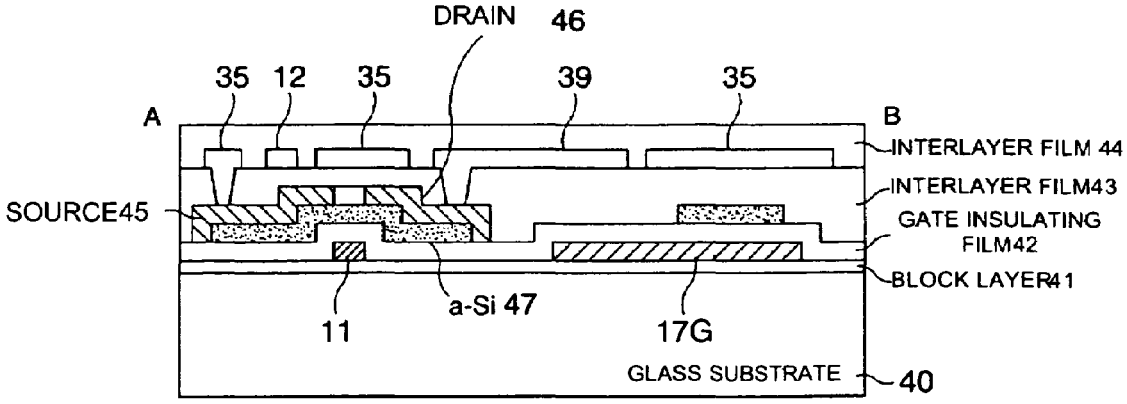
FIG. 8 is a diagram illustrating a cross-section of the pixel circuit according to the second embodiment of the invention.
Figure 9:
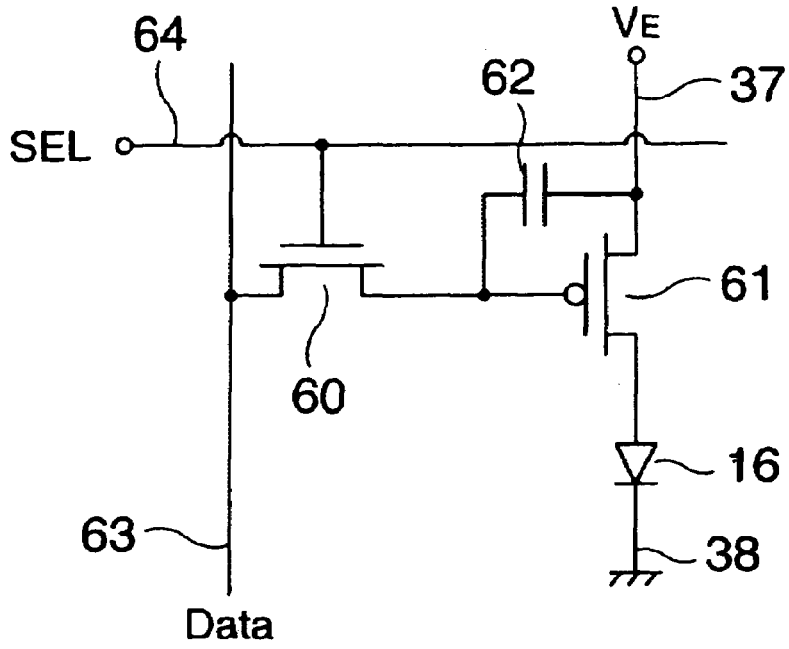
FIG. 9 is a diagram illustrating a conventional pixel circuit.

FIG. 7 shows a plan view of peripheries of the display pixel PX shown in FIG. 3, and FIG. 8 shows a cross-sectional view taken along a line A-B in FIG. 7. A metal wiring layer 35 as shown in FIG. 8 is a power wiring line VEL provided every row of the display pixels PX, is arranged in areas of the driving transistor 17, the electrical conduction transistor 22, the pixel selecting switch 13, and the bias transistor 21, and is formed to cover channel regions of the transistors as shown in FIGS. 7 and 8. The storage capacitor 18 is formed through capacitive combination of the metal wiring layer 35 and gate wiring line 17G, and the kick capacitor 20 is formed through capacitive combination of the gate wiring line 17G and the source electrode metal wiring line 39 of the pixel selecting switch 13. The capacitance values of the kick capacitor 20 and the storage capacitor 18 are much larger than the capacitance value formed parasitically by the node VG1 and the node VG2.

In FIG. 7, a bottom emission structure is supposed and thus the organic EL element 16 is arranged to be separated from areas for arranging the TFTs, but a top emission structure in which the organic EL elements are formed on a planarized interlayer film 44 to use the whole surface of the pixel area may be implemented. In this case, the ground power wiring line 38 (GND) and the VEL power wiring line 35 which is a driving power wiring line of the light-emitting element 16 have portions in the same layer as the metal wiring layer 35 or 39 shown in FIG. 8, and the ground power wiring line 38 (GND) and the VEL power wiring line 35 are arranged to intersect each other. Since the common electrode that is the ground power source GND of the light-emitting element 16 is formed separately as an uppermost electrode of the light-emitting layer, the driving current of the light-emitting element 16 may be allowed not to flow directly in the ground power wiring line 38 (GND). For this reason, even when a portion three-dimensionally intersecting the VEL power wiring line 35 is formed using semiconductor islands, it is difficult to influence operation characteristics of the pixel circuit.

Now, light-emitting devices to which the invention can be applied will be described. Examples of the light-emitting devices to which the invention can be applied may suitably include organic EL devices employing organic light-emitting materials such as low-molecular-weight material, highmolecular-weight material, dendrimer or the like, field emission devices (FED), surface-conduction type emission devices (SED), ballistic electron-emitting devices (BSD), voluntarily light-emitting devices, such as light-emitting diodes (LED).

Examples of driving apparatuses to which the invention can be applied may include displays employing the aforementioned light-emitting devices, write heads of optically-writing printer or electronic copiers, and the like. The electro-optical device according to the invention can be applied to various apparatuses having a function of displaying images, such as a large-screen television, a computer monitor, an illumination apparatus having a display function, a mobile phone, a game machine, an electronic paper, a video camera, a digital still camera, a car navigation apparatus, a car stereo apparatus, console panel, a printer, a scanner, a copier, a video player, a pager, an electronic note, an electronic calculator, a word processor, etc.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the spirit and scope of the invention.

What is claimed is:

1. An electro-optical device, comprising:

a plurality of scanning lines;

a plurality of data lines;

a plurality of pixels arranged correspondingly to intersections of the plurality of scanning lines and the plurality of data lines; and a plurality of first power wiring lines, each of the plurality of pixels further comprising:

a first switching transistor an electrical conduction of which is controlled based on a scan signal supplied through a corresponding scanning line of the plurality of scanning lines;

an electro-optical element having a pixel electrode, a common electrode, and an electro-optical material therebetween;

a driving transistor coupled to the electro-optical element; and a capacitor which has a first electrode and a second electrode forming a capacitance and which is coupled to a gate of the driving transistor through the first electrode, the capacitor holding, as electric charge, a data signal supplied through the first switching transistor and a corresponding data line of the plurality of data lines, an electrical conduction state of the driving transistor being set in accordance with a quantity of electric charge held in the capacitor, and the electro-optical element and the corresponding first power wiring line of the plurality of first power wiring lines being electrically coupled to each other through the driving transistor in accordance with an electrical conduction state thereof, and the second electrode being coupled between the driving transistor and the pixel electrode.

2. The electro-optical device according to claim 1, the first predetermined potential being equal to the potential of the common electrode.

3. The electro-optical device according to claim 1, the driving transistor being an n-channel transistor or a p-channel transistor.

4. The electro-optical device according to claim 1, the driving transistor being an amorphous thin film transistor.

5. The electro-optical device according to claim 1, in each of the plurality of pixels, before the data signal is supplied through the corresponding data line of the plurality of data lines, an electrode of the first switching transistor at a side holding the data signal is set to a second predetermined potential.

6. The electro-optical device according to claim 5, each of the plurality of pixels further including a second switching transistor that controls a connection between the electrode of the first switching transistor at a side holding the data signal and the second predetermined potential, and an electrical conduction state of the second switching transistor being controlled by a periodic signal supplied before a scan signal that controls an electrical conduction state of the first switching transistor is supplied.

7. The electro-optical device according to claim 6, the periodic signal that controls the electrical conduction state of the second switching transistor being supplied through one of the plurality of scanning lines before the scan signal that controls the electrical conduction state of the first switching transistor is supplied.

8. The electro-optical device according to claim 1, in each of the plurality of pixels, the second electrode being set to a first predetermined potential until the data signal supplied through the corresponding data line of the plurality of data lines is intercepted by the first switching transistor.

9. The electro-optical device according to claim 1, each of the plurality of pixels further including a plurality of second power wiring lines that supply the first predetermined potential to the second electrode included in each of the plurality of pixels.

10. The electro-optical device according to claim 9, the plurality of first power wiring lines and the plurality of second power wiring lines sharing a metal wiring layer portion, and being arranged to intersect each other.

11. The electro-optical device according to claims 1, the electro-optical element being an organic electroluminescent element.

12. An electro-optical device, comprising:

a plurality of scanning lines;

a plurality of data lines;

a plurality of pixels arranged correspondingly to intersections of the plurality of scanning lines and the plurality of data lines; and a plurality of first power wiring lines, each of the plurality of pixels further comprising:

a first switching transistor an electrical conduction of which is controlled based on a scan signal supplied through a corresponding scanning line of the plurality of scanning lines;

an electro-optical element having a pixel electrode, a common electrode, and an electro-optical material therebetween;

a driving transistor coupled to the electro-optical element; and a capacitor which has a first electrode and a second electrode forming a capacitance and which is coupled to a gate of the driving transistor through the first electrode, the capacitor holding, as electric charge, a data signal supplied through the first switching transistor and the corresponding data line of the plurality of data lines, an electrical conduction state of the driving transistor being set in accordance with a quantity of electric charge held in the capacitor, and the electro-optical element and the corresponding first power wiring line of the plurality of first power wiring lines being electrically coupled to each other through the driving transistor in accordance with the electrical conduction state thereof, and the second electrode being coupled between the driving transistor and the pixel electrode, and the second electrode being set to a first predetermined potential by an electrically conducting switching device that controls an electrical connection between the second electrode and the first predetermined potential.

13. An electro-optical device, comprising:

a plurality of scanning lines;

a plurality of data lines;

a plurality of pixels arranged correspondingly to intersections of the plurality of scanning lines and the plurality of data lines; and a plurality of first power wiring lines, each of the plurality of pixels further comprising:

a first switching transistor an electrical conduction of which is controlled based on a scan signal supplied through the corresponding scanning line of the plurality of scanning lines;

an electro-optical element having a pixel electrode, a common electrode, and an electro-optical material therebetween;

a driving transistor coupled to the electro-optical element; and a capacitor which has a first electrode and a second electrode forming a capacitance and which is coupled to a gate of the driving transistor through a first electrode, the capacitor holding, as electric charge, a data signal supplied through the first switching transistor and the corresponding data line of the plurality of data lines, an electrical conduction state of the driving transistor being set in accordance with a quantity of electric charge held in the capacitor, and the electro-optical element and the corresponding first power wiring line of the plurality of first power wiring lines being electrically coupled to each other through the driving transistor in accordance with an electrical conduction state thereof, and the electro-optical element being set to a non-activated state based on a scan signal supplied through one of the plurality of scanning lines, before the scan signal that controls an electrical conduction state of the first switching transistor is supplied.

14. A driving device for driving a plurality of electro-optical elements arranged in a matrix, the driving device comprising:

a plurality of scanning lines;

a plurality of data lines;

a plurality of first power wiring lines; and a plurality of pixel circuits arranged correspondingly to intersections of the plurality of scanning lines and the plurality of data lines, each of the plurality of pixel circuits further comprising:

a first switching transistor the electrical conduction of which is controlled based on a scan signal supplied through a corresponding scanning line of the plurality of scanning lines;

a driving transistor that controls current to be supplied to the electro-optical element in accordance with an electrical conduction state thereof; and a capacitor which has a first electrode and a second electrode forming a capacitance and which is coupled to a gate of the driving transistor through a first electrode, the capacitor holding, as electric charge, a data signal supplied through the first switching transistor and the corresponding data line of the plurality of data lines, the electrical conduction state of the driving transistor being set in accordance with the quantity of electric charge held in the capacitor, and current having a current level corresponding to an electrical conduction state that is supplied to the corresponding electro-optical element of the plurality of electro-optical elements through the driving transistor from the corresponding first power wiring line of the plurality of first power wiring lines, and the second electrode being coupled to a source of the driving transistor, and for at least a period before the data signal is supplied to the capacitor, the source of the driving transistor being electrically coupled to a first predetermined potential through a switching device.

15. The driving device according to claim 14, the driving transistor being an n-channel transistor or a p-channel transistor.

16. The driving device according to claim 14, the driving transistor and the first switching transistor being amorphous thin film transistors.

17. The driving device according to claim 14, for at least a period before the data signal is supplied to the capacitor, an electrode of the first switching transistor at a side holding the data signal being set to a second predetermined potential.

18. The driving device according to claim 17, each of the plurality of pixel circuits further including a second switching transistor that controls a connection between the electrode of the first switching transistor at the side holding the data signal and the second predetermined potential, and an electrical conduction state of the second switching transistor being controlled by a periodic signal supplied before a scan signal that controls an electrical conduction state of the first switching transistor is supplied.

19. The driving device according to claim 18, the periodic signal that controls the electrical conduction state of the second switching transistor being supplied through one of the plurality of scanning lines before the scan signal that controls the electrical conduction state of the first switching transistor is supplied.

20. The driving device according to claim 17, the second switching transistor and the switching device being controlled by a common signal.

21. The driving device according to claim 14, each of the plurality of pixel circuits further including a plurality of second power wiring lines that set a potential of the source of the driving transistor to the first predetermined potential through the switching device.

22. The driving device according to claim 21, the plurality of first power wiring lines and the plurality of second power wiring lines sharing a metal wiring layer portion, and being arranged to intersect each other.

23. The driving device according to claim 22, the first predetermined potential being equal or substantially equal to that of a potential of the plurality of first power wiring lines or a potential of the plurality of second power wiring lines which ever is lower.

24. A driving device for driving a plurality of electro-optical elements arranged in a matrix, the driving device comprising:

a plurality of scanning lines;

a plurality of data lines;

a plurality of first power wiring lines; and a plurality of pixel circuits arranged correspondingly to intersections of the plurality of scanning lines and the plurality of data lines, each of the plurality of pixel circuits including:

a first switching transistor an electrical conduction of which is controlled based on a scan signal supplied through the corresponding scanning line of the plurality of scanning lines;

a driving transistor that controls current to be supplied to the electro-optical element in accordance with an electrical conduction state thereof; and a capacitor which has a first electrode and a second electrode forming a capacitance and which is coupled to a gate of the driving transistor through a first electrode, the capacitor holding, as electric charge, a data signal supplied through the first switching transistor and the corresponding data line of the plurality of data lines, the electrical conduction state of the driving transistor being set in accordance with a quantity of electric charge held in the capacitor, and current having a current level corresponding to an electrical conduction state being supplied to the corresponding electro-optical element of the plurality of electro-optical elements through the driving transistor from the corresponding first power wiring line of the plurality of first power wiring lines, the second electrode being connected to a source of the driving transistor, and for at least a period when the capacitor holds the quantity of electric charge corresponding to the data signal, a device that keeps constant a potential difference between a source and a gate of the driving transistor being further provided.

* * * * *